US008058610B2

(12) United States Patent
Harada et al.

(10) Patent No.: US 8,058,610 B2
(45) Date of Patent: Nov. 15, 2011

(54) MASS SPECTROMETER

(75) Inventors: Takahiro Harada, Kizugawa (JP); Sadao Takeuchi, Nagaokakyo (JP); Kiyoshi Ogawa, Kizugawa (JP); Mitsutoshi Setou, Hamamatsu (JP)

(73) Assignee: Shimadzu Corporation, Kyoto (JP)

( * ) Notice: Subject to any disclaimer, the term of this patent is extended or adjusted under 35 U.S.C. 154(b) by 260 days.

(21) Appl. No.: 12/515,674

(22) PCT Filed: Dec. 5, 2006

(86) PCT No.: PCT/JP2006/324259

§ 371 (c)(1), (2), (4) Date: May 20, 2009

(87) PCT Pub. No.: WO2008/068847

PCT Pub. Date: Jun. 12, 2008

(65) Prior Publication Data

US 2010/0044563 A1 Feb. 25, 2010

(51) Int. Cl.
*H01J 49/04* (2006.01)
*H01J 49/00* (2006.01)

(52) U.S. Cl. ..... 250/288; 250/281; 250/282; 250/287

(58) Field of Classification Search ..... 250/281, 250/282, 287, 288

See application file for complete search history.

(56) References Cited

U.S. PATENT DOCUMENTS 6,906,320 B2 * 6/2005 Sachs et al. ..... 250/282
6,931,325 B2 * 8/2005 Wall et al. ..... 702/19
7,064,318 B2 * 6/2006 Bui ..... 250/282

(Continued)

FOREIGN PATENT DOCUMENTS

JP 2001-154112 A 6/2001

(Continued)

OTHER PUBLICATIONS

Kiyoshi Ogawa, et al., "Research and Development of Mass Microscope (Kenbi Shitsuryou Bunseki Souchi No Kaihatsu)," Shimadzu Review (Shimazu Hyoron), Mar. 31, 2006, pp. 125-135, vol. 62, No. 3-4.

(Continued)

*Primary Examiner* — David A Vanore
(74) *Attorney, Agent, or Firm* — Sughrue Mion, PLLC

(57) ABSTRACT

A sample plate 3 with a sample 4 placed thereon is initially set on a stage 2, and a visual image of the sample is taken with a CCD camera 14. This image is stored in an image data memory 23. Then, an operator removes the sample plate 3, sprays a matrix for a MALDI process onto the sample 4 and replaces the plate onto the stage 2. After that, when a predetermined operation is made, a clear image of the sample taken before the application of the matrix is shown on a display unit 24. On this image, the operator specifies a point or area for the analysis. The sample 4 may have been displaced due to the removal and replacement of the plate 3. Accordingly, an image analyzer 44 calculates the direction and magnitude of the displacement, for example, by recognizing the position of the markings provided on the sample plate 3. A displacement corrector 42 computes coordinate values in which the displacement is corrected. Thus, even if a displacement occurs, the mass analysis can be accurately performed on the point or area of the actual sample as specified on the clear visual image taken before the application of the matrix.

32 Claims, 9 Drawing Sheets

U.S. PATENT DOCUMENTS

| | | | | |
|---|---|---|---|---|
| 7,138,625 | B2 * | 11/2006 | Overney et al. | 250/288 |
| 7,206,700 | B2 * | 4/2007 | Neacsu et al. | 702/23 |
| 7,411,183 | B2 * | 8/2008 | Overney et al. | 250/282 |
| 7,759,640 | B2 * | 7/2010 | Setou et al. | 250/288 |
| 2009/0146053 | A1 * | 6/2009 | Setou et al. | 250/281 |
| 2009/0283673 | A1 * | 11/2009 | Shilov et al. | 250/282 |

FOREIGN PATENT DOCUMENTS

| | | | |
|---|---|---|---|
| JP | 2004-340646 | A | 12/2004 |
| JP | 2005-243466 | A | 9/2005 |
| JP | 2005-283125 | A | 10/2005 |

OTHER PUBLICATIONS

Shuichi Shimma, et al., "Review of Imaging Mass Spectrometry," J. Mass Spectrom. Soc. Jpn., 2005, pp. 230-238, vol. 53, No. 4.

Bernhard Spengler, et al., "Scanning Microprobe Matrix-Assisted Laser Desorption Ionization (SMALDI) Mass Spectrometry: Instrumentation for Sub-Micrometer Resolved LDI and MALDI Surface Analysis," J Am Soc Mass Spectrom, 2002, pp. 735-748, vol. 13.

Written Opinion of the International Searching Authority dated Mar. 13, 2007, issued in corresponding International application No. PCT/JP2006/324259.

* cited by examiner (a) BEFORE APPLICATION OF MATRIX (b) AFTER APPLICATION OF MATRIX

MASS SPECTROMETER

TECHNICAL FIELD

The present invention relates to a mass spectrometer, and more specifically to a mass spectrometer having an ion source employing MALDI (matrix-assisted laser desorption/ionization), for performing a mass analysis of a predetermined point or area on a sample.

BACKGROUND ART

Matrix-assisted laser desorption ionization (MALDI) is a technique suitable for an analysis of samples that barely absorb laser light or samples that will be easily damaged by laser light, such as protein. In this technique, a substance that is highly absorptive of laser light and easy to ionize is mixed beforehand into the sample, and this mixture is irradiated with laser light to ionize the sample. Particularly, mass spectrometers using the MALDI technique (which is hereinafter called the MALDI-MS) can analyze high molecular compounds having large relative molar masses without severely dissociating them. Moreover, mass spectrometers of this type are suitable for microanalysis. Due to these characteristics, the MALDI-MS has been widely used in recent years in biosciences and other fields.

In a MALDI-MS, reducing the spot size of the irradiation laser beam and relatively moving the spot on a sample provides an image that represents, for example, an intensity distribution of an ion having a specific mass (or two-dimensional distribution of a substance) on the sample. Such "imaging mass spectrometer" is expected to be particularly applicable, for example, in biochemical, medical and other fields to obtain distribution information of protein contained in biological cells (for example, refer to Non-Patent Document 1 and other documents).

In order to obtain useful information on a sample in the aforementioned application fields, it is desirable to perform the mass analysis with a high spatial resolution. The simplest yet most reliable method for improving the spatial resolution is to reduce the irradiation area of the laser beam so that the substance ionization can occur only within a small area. Normal types of MALDI-MS use a laser beam having a focused diameter of approximately several hundreds of μm, whereas the imaging mass spectrometer described in the aforementioned document uses a laser beam focused to be as small as approximately 30 μm in diameter. Furthermore, Non-Patent Document 2 and other documents disclose an example in which the laser beam was focused to a diameter of approximately 0.5 μm to obtain an image showing the substance distribution within a cell roughly several tens of μm in size. Due to such a high spatial resolution, these MALDI-MS systems can be used for a local analysis of a microsized area as well as for the determination of a one-dimensional or two-dimensional substance distribution.

In the case of performing a local analysis of a sample or obtaining a substance distribution image by means of, for example, an imaging mass spectrometer disclosed in the aforementioned documents, the sample is normally cut into a slice having a thickness from a few μm to several tens of μm and placed on a sample plate. Conventionally, the analysis process typically includes the following steps performed by an operator: removing the sample plate from the apparatus, placing a sample on the same plate, applying a matrix to the sample, and replacing the plate into the apparatus. Then, while observing the sample through a CCD camera or eyepiece, the operator specifies an analysis point or area by using the currently observed image (normally, a real-time image). Subsequently, a laser beam is delivered onto the specified point or area to perform the mass analysis.

The matrix, which is typically a solid, is subsequently dissolved in an organic solvent or the like, and the resultant matrix solution is placed on the sample. When the matrix solution is placed on the sample, a substance to be analyzed elutes from the sample into the solution. Subsequently, the solvent is vaporized to form a matrix crystal, with the aforementioned substance retained inside the crystal. Irradiating this crystal with a laser beam causes the ionization of the substance to be analyzed.

Various techniques have been proposed as a method for placing a matrix solution on a sample. One of the simplest methods is to drop a matrix solution of approximately several hundreds of nL onto a desired location. This operation can be performed with a commonly used manual pipetter and is therefore the simplest and inexpensive method. However, it has the drawback that the drop has such a large diameter (which is 2 to 3 mm for a drop of 500 nL) that the positional information of the substance to be analyzed will be lost after it elutes from the sample. This method is useful if a rough determination of the position suffices, but unsuitable for acquiring distribution information of a substance or performing a local analysis.

The most widely used method is to spray the matrix solution onto the sample. This method can uniformly place the matrix over a wide area of the sample and is suitable for acquiring substance distribution images. Due to the use of smaller droplets, the positional information is more precisely retained than in the aforementioned dropping method, so that the substance distribution image can be obtained with a high level of resolution.

Another conventional method includes discretely placing microsized droplets on a sample with an automatic pipetter. This method at least prevents the substance to be analyzed from moving between the neighboring droplets, so that the substance distribution image can be accurately produced. However, it is difficult to produce as small a droplet as in the spraying method, so that the spatial resolution of the substance distribution image cannot be equal to or higher than that achieved by the spraying method.

Regardless of which method is used, the matrix will eventually crystallize after the solution on the sample is dried. Although the matrix crystal is normally transparent, its observed image tends to be unclear due to the complex or fine shape of the crystal. FIGS. 13(*a*) and 13(*b*) are photographic images of a sample observed before and after a matrix solution is sprayed. The sample used in this example was a slice of a mouse's brain, onto which a CHCA solution was sprayed. As demonstrated in FIG. 13(*b*), the image of the sample surface becomes rather obscure after the matrix was applied. With such an unclear image, it is difficult to correctly select a specific area or point for the acquisition of a substance distribution image of a desired area on the sample or for a local analysis of a specific point on the sample.

Thus, the previously described imaging mass spectrometers using conventional MALDI techniques cannot always correctly perform the mass analysis of a desired point or area on a sample. Therefore, the user may possibly overlook really-required information or be forced to repeat the same analysis many times.

Non-Patent Document 1: Kiyoshi Ogawa et al., "Kenbi Shitsuryou Bunseki Souchi No Kaihatsu (Research and Development of Mass Microscope)", *Shimadzu Hyouron* (*Shimadzu Review*), Shimadzu Hyouron Henshuu-bu, Mar. 31, 2006, Vol. 62, No. 3/4, pp. 125-135

Non-Patent Document 2: B. Spengler et al, "Scanning Microprobe Matrix-Assisted Laser Desorption Ionization (SM-ALDI) Mass Spectrometry: Instrumentation for Sub-Micrometer Resolved LDI and MALDI Surface Analysis", *Journal of American Society for Mass Spectrometry,* 2002, Vol. 13, No. 6, pp. 735-748

DISCLOSURE OF THE INVENTION

Problem to be Solved by the Invention

The present invention has been developed in view of the aforementioned problems, and its objective is to provide a mass spectrometer capable of a MALDI analysis in which a desired point or area for the analysis can be correctly specified on a sample, and the substance distribution or other information on the specified point or area can be accurately collected.

Means for Solving the Problems

A first aspect of the present invention aimed at solving the aforementioned problem is a mass spectrometer having an apparatus body in which a sample plate, on which a sample by matrix-assisted laser desorption ionization including the steps of applying a matrix to the sample placed on the sample plate removed from the apparatus body, then setting the sample plate into the apparatus body, and delivering a laser beam onto the sample to which the matrix is applied, which is characterized by including:

a) an image acquiring section for taking and holding a two-dimensional image of the sample on the sample plate when the sample plate carrying the sample with no matrix applied thereto is set in the apparatus body;

b) a specifying section for allowing an operator to specify a desired point on a display screen of a display section on which the two-dimensional image held by the image acquiring section is displayed; and c) an analysis controlling section for delivering the laser beam onto the point of the sample specified through the specifying section, and for performing a mass analysis on the point, when the sample plate carrying the sample with the matrix applied thereto is set in the apparatus body.

A second aspect of the present invention aimed at solving the aforementioned problem is a mass spectrometer having an apparatus body in which a sample plate, on which a sample is to be placed, can be set in a removable manner, and an ion source for ionizing the sample by matrix-assisted laser desorption ionization including the steps of applying a matrix to the sample placed on the sample plate removed from the apparatus body, then setting the sample plate into the apparatus body, and delivering a laser beam onto the sample to which the matrix is applied, which is characterized by including:

a) an image acquiring section for taking and holding a two-dimensional image of the sample on the sample plate when the sample plate carrying the sample with no matrix applied thereto is set in the apparatus body;

b) a specifying section for allowing an operator to specify a desired one-dimensional or two-dimensional area on a display screen of a display section on which the two-dimensional image held by the image acquiring section is displayed; and c) an analysis controlling section for performing a mass analysis on each small section of the area of the sample specified through the specifying section, by delivering the laser beam onto an irradiating position on the area while moving the irradiating position to scan the area, when the sample plate carrying the sample with the matrix applied thereto is set in the apparatus body.

The mass spectrometer according to the first aspect of the present invention is a device for a local mass analysis at one or more points on a sample, whereas the mass spectrometer according to the second aspect of the present invention is aimed at entirely examining a one-dimensional or two-dimensional area by performing a mass analysis on every small section of the area and obtaining, for example, a spatial distribution of a substance over the area. These two aspects of the invention basically share the same conception. That is, an image acquiring section is used to take a two-dimensional image of a sample before a matrix is applied to it. This image information is held even after the sample plate is removed from the apparatus body. Therefore, the two-dimensional image of the sample taken before the application of the matrix can be displayed on the display section at any point in time, e.g. after the sample plate removed from the apparatus body is replaced into the apparatus body after the matrix has been applied to the sample. On this image, the operator specifies, through the specifying section, a point or area on the sample where the analysis is required.

As stated earlier, after the matrix is applied, the two-dimensional image of the sample may be so obscure that it is difficult to find a desired point or area. By contrast, according to the present invention, the analysis point or area can be specified on a clear two-dimensional image taken before the application of the matrix, so that the operator can assuredly specify a portion to be observed. Subsequently, upon receiving a command to initiate the analysis, the analysis control section sets the irradiating position of the laser beam and controls the driving of the stage, with the sample plate placed thereon, to move the irradiating position of the laser beam so that the mass analysis will be performed on the actual point or area on the sample that corresponds to the point or area specified beforehand on the two-dimensional screen.

If the position of the sample plate is uniquely determined when it is set into the apparatus body, i.e. if there is a positional reproducibility, there will be no displacement of the sample (or only a virtually negligible displacement) regardless of how many times the sample plate is removed from and replaced into the apparatus body. Therefore, the analysis control section can determine the irradiating position of the laser beam by directly using the positional addresses of the analysis point or area specified on the two-dimensional image of the sample. On the other hand, if the sample plate is simply placed on a flat stage when it is set into the apparatus body, a displacement of the sample plate and hence that of the sample on the same plate will occur when the sample plate that has been removed is replaced into the apparatus body. In this case, it is necessary to correct the displacement between the positions before and after the removal and replacement of the sample plate, so as to deliver the laser beam onto the point or area on the sample with the matrix applied thereto that actually corresponds to the analysis point or area specified through the specifying section.

Given this factor, it is preferable for the mass spectrometers according to the first and second aspects of the present invention to further include a displacement discerning section for discerning the direction and magnitude of the displacement between the positions of either the sample plate or the sample on the sample plate before and after the removal and replacement of the sample plate from and into the apparatus body, and an irradiation point adjustment section for changing the relative position of the laser beam and the sample so as to correct the irradiating position of the laser beam according to the direction (including the angle) and magnitude of the displacement discerned by the displacement discerning section.

There are various methods available for the displacement discerning section to discern the direction and magnitude of the displacement. For example, as a first mode of the mass spectrometers according to the first and second aspects of the present invention, the displacement discerning section may display a two-dimensional image of the sample on the sample plate taken when the sample plate carrying the sample with the matrix applied thereto is set in the apparatus body and a two-dimensional image of the sample taken before the application of the matrix and held by the image acquiring section, in such a manner as to allow the comparison between the two images, and discern the direction and magnitude of the displacement on the basis of an operator indication relating to one or more identical portions on both of the two-dimensional images.

As explained earlier, a two-dimensional image of the sample taken after the application of the matrix is often unclear. However, if the sample has distinct portions in terms of its shape, pattern, color density or the like, it may be possible to visually recognize these portions even after the matrix is applied. Accordingly, in the first mode, when an operator visually compares a pair of two-dimensional images taken before and after the application of the matrix, respectively, and indicates one or more identical portions, the apparatus calculates the direction and magnitude of the displacement in response to the indication.

As the second mode of the mass spectrometers according to the first and second aspects of the present invention, the displacement discerning section may include: a comparative image acquiring section for taking a two-dimensional image of the sample on the sample plate when the sample plate carrying the sample with the matrix applied thereto is set in the apparatus; and a displacement detecting section for performing an image analysis on both of the two-dimensional image taken by the comparative image acquiring section and the two-dimensional image of the sample taken before the application of the matrix and held by the image acquiring section, to determine the direction and magnitude of the displacement between these two images.

The apparatus in the second mode automatically performs identifications and determinations for which the apparatus in the first mode relies on a visual check by an operator. The displacement detecting section for determining the direction and magnitude of the displacement between the two images can be realized by using various kinds of commercially available high-performance image processing software.

It is not necessarily the case that the sample has such a clear shape, pattern or other properties that remain discernable on the acquired image even after the matrix is applied. Accordingly, it is preferable to provide a marker for position identification on the sample plate. This marker on the sample plate can be used in place of the shape or pattern of the sample when the operator manually indicates one or more identical portions or the automatic image analysis is performed.

In the case of a large sample, the marker on the sample plate may possibly be concealed by the sample. To avoid this situation, it is preferable to provide a marker for position identification on a holder that can hold the sample plate and be set into the apparatus body.

It is preferable to provide the sample plate or holder with two or more markers for position identification, rather than only one. These markers should be as far from each other as possible.

Effect of the Invention

By the mass spectrometers according to the first and second aspects of the present invention, the point or area for the mass analysis can be determined with reference to a clear sample image taken before the matrix is applied to the sample. Therefore, a desired point or area can be correctly specified, and a mass analysis result or substance distribution image can be assuredly obtained as intended. Specifying the analysis point or area is easier than ever before since it is no longer necessary to visually check an unclear sample image to locate an analysis point or area.

EXPLANATION OF NUMERALS

1 Airtight Chamber
2 Stage
3 Sample Plate
4 Sample
5 Irradiation Window
6 Observation Window
7 Vacuum Chamber
8 Ion Transport Optical System
9 Mass Analyzer
10 Detector
11 Laser Unit
12 Laser Beam
13 Laser-Focusing Optical System
14 CCD Camera
15 Observation Optical System
16 Data Processor
17 Stage Driver
20, 30, 40 Controller
21, 31, 41 Analysis Point/Area Specifier
22, 33, 43 Analysis Point/Area Determiner
23 Image Data Memory
24 Display Unit
25 Operation Unit
32, 42 Displacement Corrector
34 Displacement Recognizer
35 Displacement Calculator
44 Image Analyzer
50 Plate Holder
51 Body
511 Hollow
512 Opening
513 Light-Passing Window
52 Cover
521 Open Window
53 Screw
M1, M2 Marking

BEST MODE FOR CARRYING OUT THE INVENTION

First Embodiment

Figure 1:
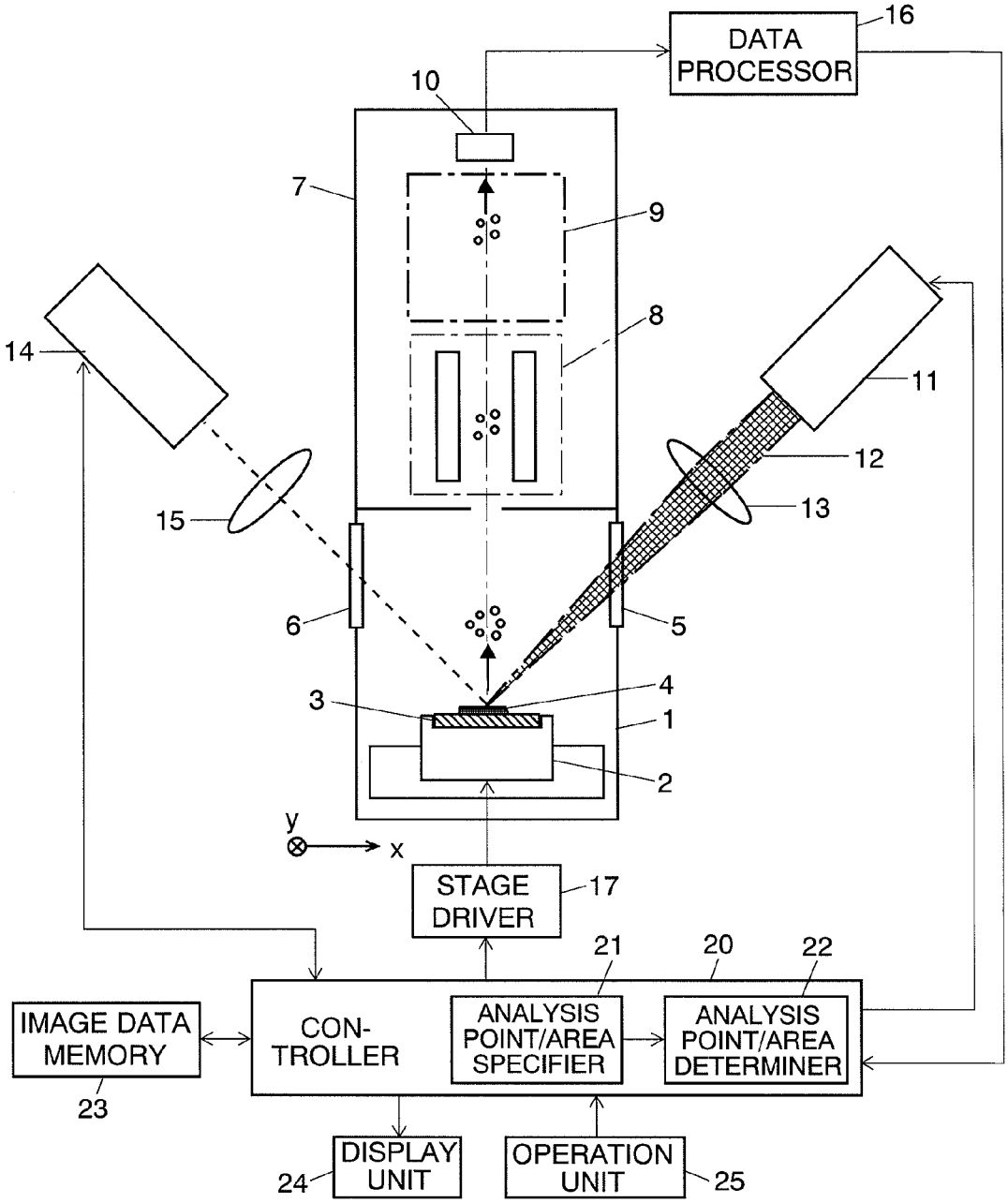
FIG. 1 is an overall configuration diagram of a MALDI imaging mass spectrometer according to the first embodiment of the present invention.

A MALDI imaging mass spectrometer, which is an embodiment (the first embodiment) of the mass spectrometer according to the present invention, is hereinafter described with reference to FIGS. 1 to 3. FIG. 1 is an overall configuration diagram of the MALDI imaging mass spectrometer according to the present embodiment.

The apparatus includes an airtight chamber 1 containing a stage 2 on which a sample plate 3, with a sample 4 placed thereon, is to be set. The airtight chamber 1 is connected to a vacuum chamber 7, which is evacuated by a vacuum pump (not shown). The vacuum chamber 7 contains an ion transport optical system 8, mass analyzer 9, detector 10 and other components. Located outside the airtight chamber 1 and vacuum chamber 7 are a laser unit 11, laser-focusing optical system 13, CCD camera 14, observation optical system 15 and other components. The ion transport optical system 8 is, for example, an electrostatically operated electromagnetic lens, a multipolar radio-frequency ion guide, or a combination of these devices. The mass analyzer 9 may be a quadrupole mass analyzer, ion trap, time-of-flight mass analyzer, magnetic sector mass analyzer, or other types of mass analyzers.

The stage 2 has a drive mechanism attached thereto (not shown), which includes a stepping motor and other components for precisely driving the stage 2 in the two axial directions, i.e. along the x and y axes orthogonal to each other. The drive mechanism is driven by a stage driver 17 under the command of a controller 20.

Under the command of the controller 20, the laser unit 11 emits an ionization laser beam 12, which is focused by the laser-focusing optical system 13 and delivered onto the sample 4 through the irradiation window 5 provided in a side face of the airtight chamber 1. The spot size of the laser beam on the sample 4 is extremely small, for example between one μm to several tens of μm. If, as explained earlier, the stage 2 is moved in the x-y plane by the drive mechanism, the position at which the laser beam 12 hits the sample 4 changes, which means that the micro area as the target of the mass analysis moves on the sample 4. In such a manner, the irradiating position of the laser beam, or the target point of the mass analysis, is moved to scan the sample 4.

Meanwhile, the CCD camera 14 takes an image of a predetermined area on the sample plate 3 through the observation window 6, which is provided in a side face of the airtight chamber 1, and the observation optical system 15. The two-dimensional image signal thereby obtained is sent to the controller 20 and, if it is necessary, stored into an image data memory 23. The imaging area (or magnifying power) is adjustable within a predetermined range. The controller 20, which acts as a supervisor for controlling the general operations of the apparatus, includes an analysis point/area specifier 21 and an analysis point/area determiner 22 as its characteristic function blocks. An operation unit 25 for allowing an operator to operate and command the apparatus, and a display unit 24 for presenting a two-dimensional visual image, two-dimensional substance distribution image or other information relating to the sample 4, are connected to the controller 20.

As already explained, the sample 4 emits ions when irradiated with the laser beam 12. These ions are introduced into the vacuum chamber 7, where they are sent through the ion transport optical system 8 into the mass analyzer 9. The mass analyzer 9 separates those ions into different kinds according to their mass-to-charge ratio. When the separated ions arrive at the detector 10, the detector 10 produces detection signals corresponding to the amount of the incident ions. These detection signals are forwarded to the data processor 16, which digitizes those signals and performs an appropriate data processing. For example, in the case of a local mass analysis of one or more points on the sample 4, the data processor 16 creates a mass spectrum for each point and performs qualitative and quantitative analyses based on the mass spectrum to identify a substance and deduce its content. In the case of a mass analysis of a predetermined area on the sample 4, the data processor 16 may, for example, create a substance distribution image by determining the signal intensity of a specific mass every time the irradiating position of the laser beam is moved as described earlier, and producing a two-dimensional image showing the signal intensity values.

At least some of the functions of the controller 20 and data processor 16 can be realized by executing a dedicated software program installed in a personal computer.

In the present imaging mass spectrometer, the sample plate 3 has a predetermined shape and size, and a hollow whose size corresponds to the outline size of the sample plate 3 is formed in the top surface of the stage 2. Accordingly, when the operator fits the sample plate 3 into the hollow, the position of the sample plate 3 on the stage 2 will be uniquely determined. This means that no displacement of the sample plate 3 will occur when the operator returns the sample plate 3 onto the stage 2 after it has been removed from the stage 2, and no displacement of the sample 4 will occur as long as the sample 4 on the sample plate 3 is the same.

A general procedure of an analysis using the MALDI imaging mass spectrometer of the present embodiment and the process operations of the apparatus during the analysis are hereinafter described with reference to FIGS. 2 and 3. FIG. 2 is a flowchart showing the procedure of an analysis by the present MALDI imaging mass spectrometer and the process operations associated with the procedure. FIG. 3 is a diagram illustrating an area-specifying operation for an analysis of a two-dimensional area on a sample.

An operator initially places a sample 4 to be analyzed onto the sample plate 3 outside the airtight chamber 1, and sets the plate 3 onto the stage 2 (Step S1). After that, when the operator gives a command to take an image through the operation unit 25 (Step S2), the controller 20 receives the command and controls the CCD camera 14 to take a visual image of the sample and display it on the screen of the display unit 24. The visual image presented on the display unit 24 at this stage is a real-time image. Watching this image, the operator varies the magnifying power and/or performs an operation for moving the stage 2 to bring an appropriate two-dimensional area on the sample 4 into the displayed image, and then performs an operation for fixing the image. As a result, the sample image at this point in time is stored in the image data memory 23 (Step S3). It is hereinafter assumed that the visual image S of the sample shown in FIG. 3(*a*) has been stored in the memory.

Next, the operator temporarily removes the sample plate 3 from the apparatus and sprays a matrix onto the sample 4. The method for applying a matrix at this stage can be chosen from various methods as previously explained and is not limited to any specific method. However, spraying a matrix solution is advantageous for obtaining a high spatial resolution. After the matrix is applied to the sample 4, the sample plate 3 is reset onto the stage 2 (Step S4). As already described, the sample 4 comes to the same position on the x-y plane as the position where it was located before the sample plate 3 was removed. The sample 4 normally cannot be clearly observed after the matrix is applied.

After the sample 4 to be analyzed has been prepared in the aforementioned manner, the operator uses the operation unit 25 to confirm that the sample is ready. Then, the controller 20 reads out image data from the image data memory 23 and displays it on the screen of the display unit 24. As a result, a visual image S of the sample taken before the application of the matrix is presented on the display unit 24, as shown in FIG. 3(*a*) but without the area-indicating frame A (Step S5). Thus, a clear image with no the matrix applied thereto is shown on the screen of the display unit 24, even though the sample 4 actually set on the stage 2 at this point is covered with the matrix and hence its clear image cannot be obtained. For example, the actual image of the sample will be as shown in FIG. 3(*b*).

On this visual image S of the sample, the operator specifies a desired point or area (one-dimensional or two-dimensional area) for the analysis (Step S6). For example, the analysis point/area specifier 21 superposes an area-indicating frame A on the visual image S of the sample as shown in FIG. 3(*a*), allowing the operator to specify a two-dimensional area by changing the size or position of this area-indicating frame A through the operation unit 25. Naturally, this is not the only method for specifying a point or area; for example, it is possible to numerically enter the coordinate values.

After that, the controller 20 controls each component of the apparatus to perform a mass analysis on the specified point or area on the sample 4 (Step S7). For example, if a two-dimensional area has been specified on the sample 4 by the analysis point/area specifier 21 as described previously, the analysis point/area determiner 22 fixes the two-dimensional area as the area to be analyzed and calculates the coordinate values (positional addresses) of this two-dimensional area. As already explained, the position of the sample plate 3 on the stage 2 is uniquely determined. Therefore, the coordinate values calculated from the area specified on the two-dimensional visual image S of the sample taken before the application of the matrix as shown in FIG. 3(*a*), coincide with the coordinate values of the analysis area on the actual sample 4 with the matrix applied thereto as shown in FIG. 3(*b*).

Based on the calculated coordinate values, the controller 20 controls the drive mechanism through the stage driver 17 so that the micro area onto which the laser beam 12 should be delivered is sequentially moved in a stepwise manner. As a result, the stage 2 moves in steps of an infinitesimal distance. Every time the stage 2 halts at intervals of the infinitesimal distance, a pulse of laser beam 12 is delivered from the laser unit 11 to perform the mass analysis for a micro area on the sample 4. In this manner, all the micro areas within the targeted analysis area on the sample 4 are subjected to the mass analysis. Then, the data processor 16 creates, for example, a map (or two-dimensional substance distribution image) of the signal intensity of a specific mass for an objective substance, and displays it on the screen of the display unit 24 (Step S8).

The previously described basic procedure and process operations are also applicable for a local analysis of a single point or a plurality of discrete points on the sample 4: After one or more analysis points are specified on the visual image of the sample taken before the application of the matrix, the coordinate values of each analysis point are calculated, and the mass analysis is performed after the position of the stage 2 is adjusted so that the laser beam 12 will be delivered onto the point having the calculated coordinate values on the sample 4 with the matrix applied thereto.

In the previous description, the specification of the analysis point or area in Step S6 was performed after the sample 4 with the matrix applied thereto was set on the stage 2. However, the analysis point or area can be specified at any point in time, i.e. even when the sample 4 with no matrix applied thereto is on the stage 2, or even when the sample plate 3 is removed from the stage 2, as long as the visual image of the sample to be used for specifying the analysis point or area is held in the image data memory 23.

As described to this point, in the MALDI imaging mass spectrometer of the present embodiment, it is possible to specify an analysis point or area on a clear visual image of a sample taken before the application of a matrix, so that a desired position or area can be easily and accurately specified. Since the visual image of the sample taken after the application of the matrix does not need to be clear, it is possible to use, in place of a liquid matrix, a solid matrix, such as α-CHCA (α-cyano-4-hydroxycinnamic acid), DHB (2,5-dihydroxybenzoic acid) or sinapic acid. Using the method of spraying a solution of a solid matrix enables the mass analysis to be performed with high spatial resolution.

Second Embodiment

Figure 4:
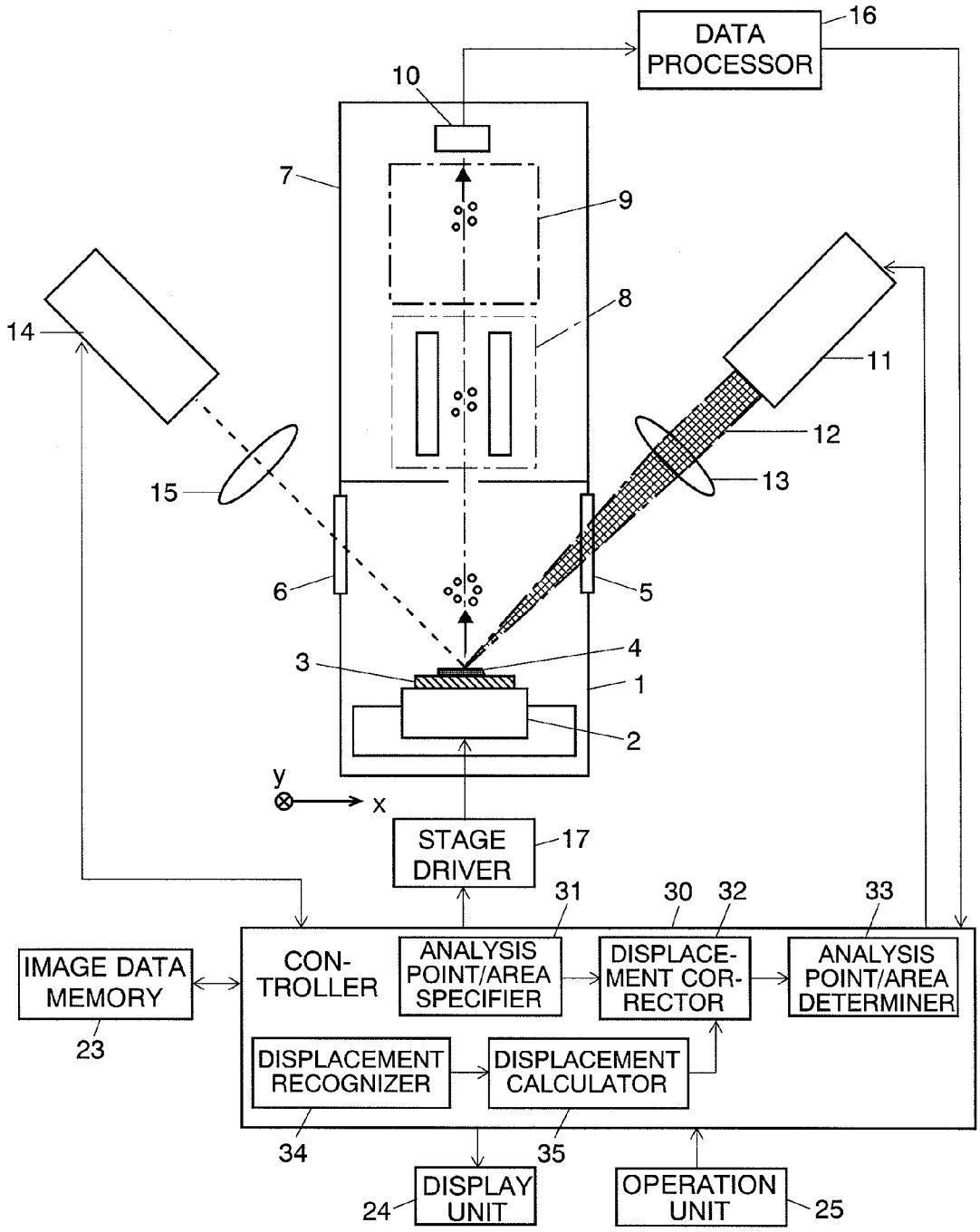
FIG. 4 is an overall configuration diagram of a MALDI imaging mass spectrometer according to the second embodiment of the present invention.

A MALDI imaging mass spectrometer, which is another embodiment (the second embodiment) of the mass spectrometer according to the present invention, is hereinafter described with reference to FIGS. 4 to 7. FIG. 4 is an overall configuration diagram of the MALDI imaging mass spectrometer according to the second embodiment. The same components as those already described in the first embodiment shown in FIG. 1 will be denoted by the same numerals, and their explanations will be omitted.

The first embodiment has assumed that the position of the sample plate 3 is uniquely determined when it is set onto the stage 2. However, if this positioning system lacks mechanical accuracy, or if there are no means for controlling the position of the sample plate 3 on the stage 2, it is highly possible that a displacement of the sample plate 3, or the sample 4 placed thereon, will occur between the position where the sample plate 3 was originally set on the stage 2 before the application of the matrix and the position where the plate has been replaced onto the stage after it was temporarily removed and the matrix was applied. Therefore, if the position for the mass analysis is determined, as in the first embodiment, by directly using the coordinate values calculated from an analysis point or area specified based on a visual image S of the sample taken before the application of the matrix, an unwanted displacement of the analysis point or area on the sample 4 will result. In view of this displacement, the MALDI imaging mass spectrometers in the second and subsequent embodiments are all provided with a function for correcting the displacement.

The imaging mass spectrometer of the second embodiment has a controller 30 in place of the controller 20 used in the imaging mass spectrometer in the first embodiment. The controller 30 includes an analysis point/area specifier 31, displacement corrector 32, analysis point/area determiner 33, displacement recognizer 34 and displacement calculator 35.

Figure 5:
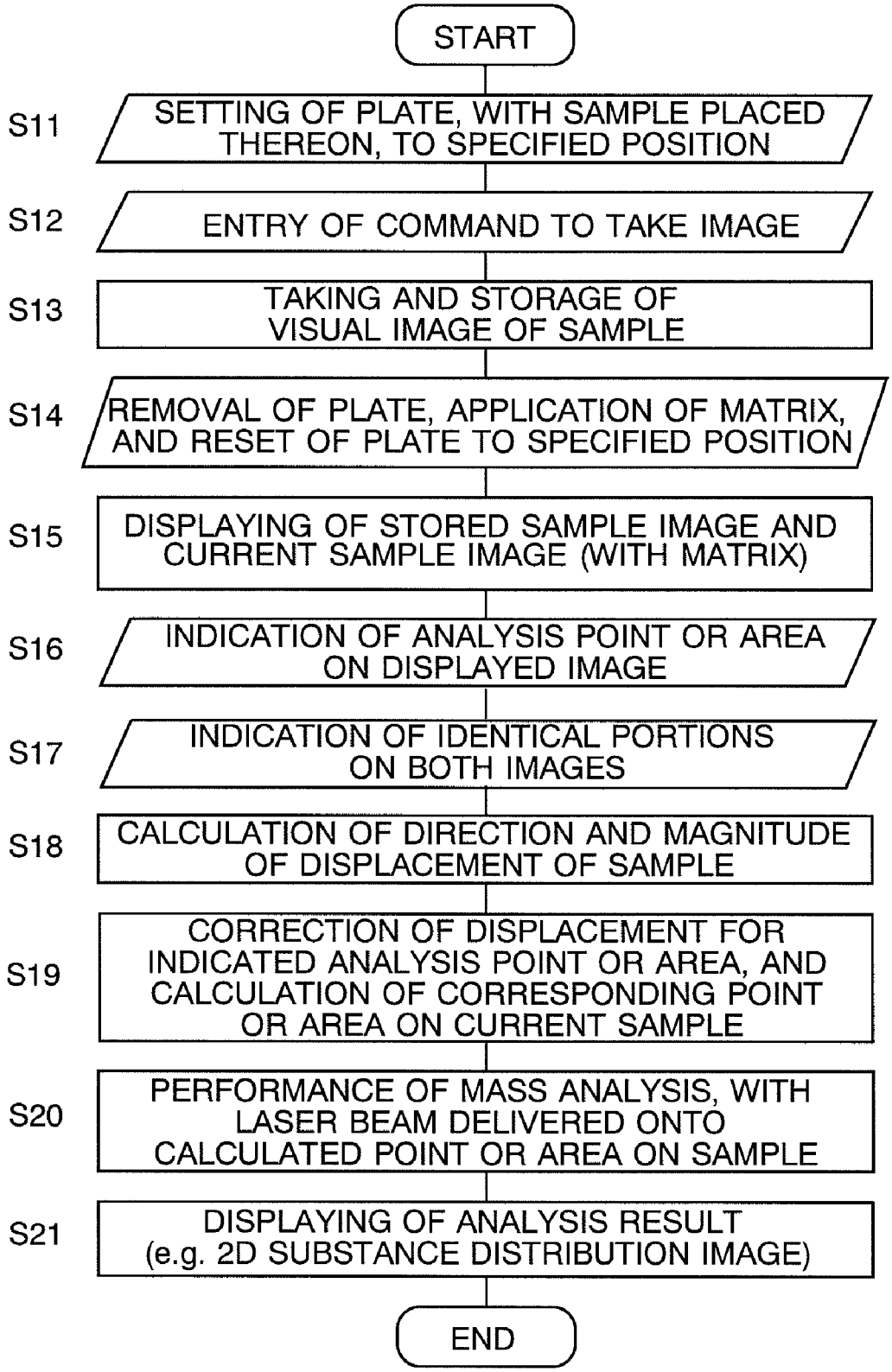
FIG. 5 is a flowchart showing the procedure of an analysis by the MALDI imaging mass spectrometer according to the second embodiment and the process operations associated with the procedure.
Figure 6:
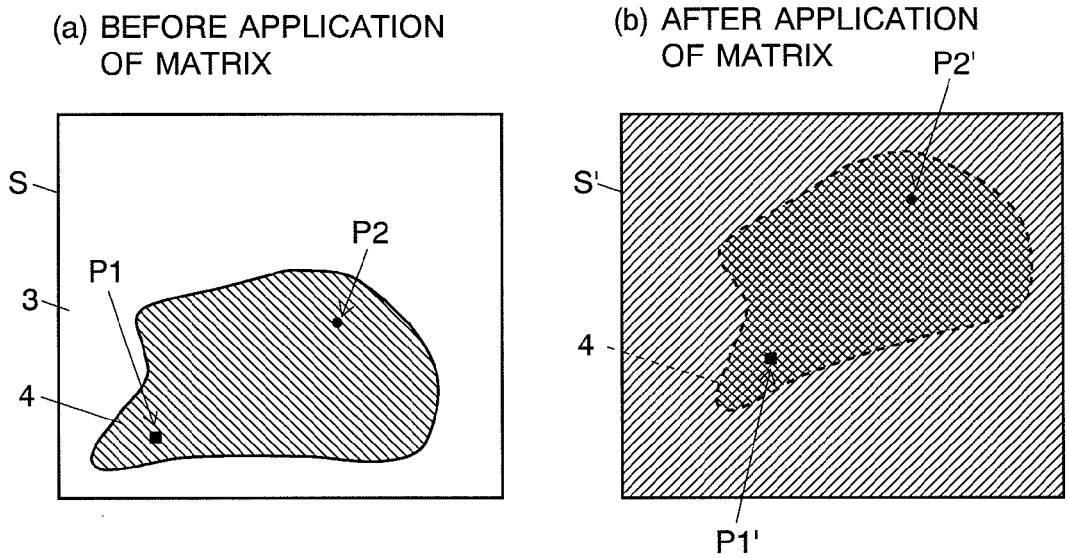
FIG. 6 is a diagram illustrating an area-specifying operation for an analysis of a two-dimensional area on a sample by the MALDI imaging mass spectrometer according to the second embodiment.
Figure 7:
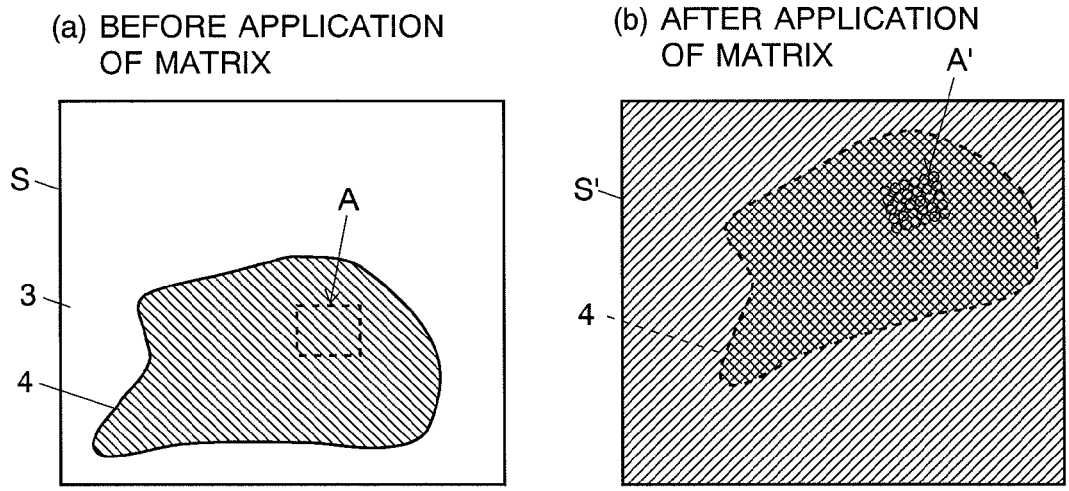
FIG. 7 is a diagram illustrating an area-specifying operation for an analysis of a two-dimensional area on a sample by the MALDI imaging mass spectrometer according to the second embodiment.

A general procedure of an analysis using the MALDI imaging mass spectrometer of the present embodiment and the process operations of the apparatus during the analysis are hereinafter described with reference to FIGS. 5 to 7. FIG. 5 a flowchart showing the procedure of an analysis by the present imaging mass spectrometer and the process operations associated with the procedure. FIGS. 6 and 7 illustrate an area-specifying operation for an analysis of a two-dimensional area on a sample.

Figure 2:
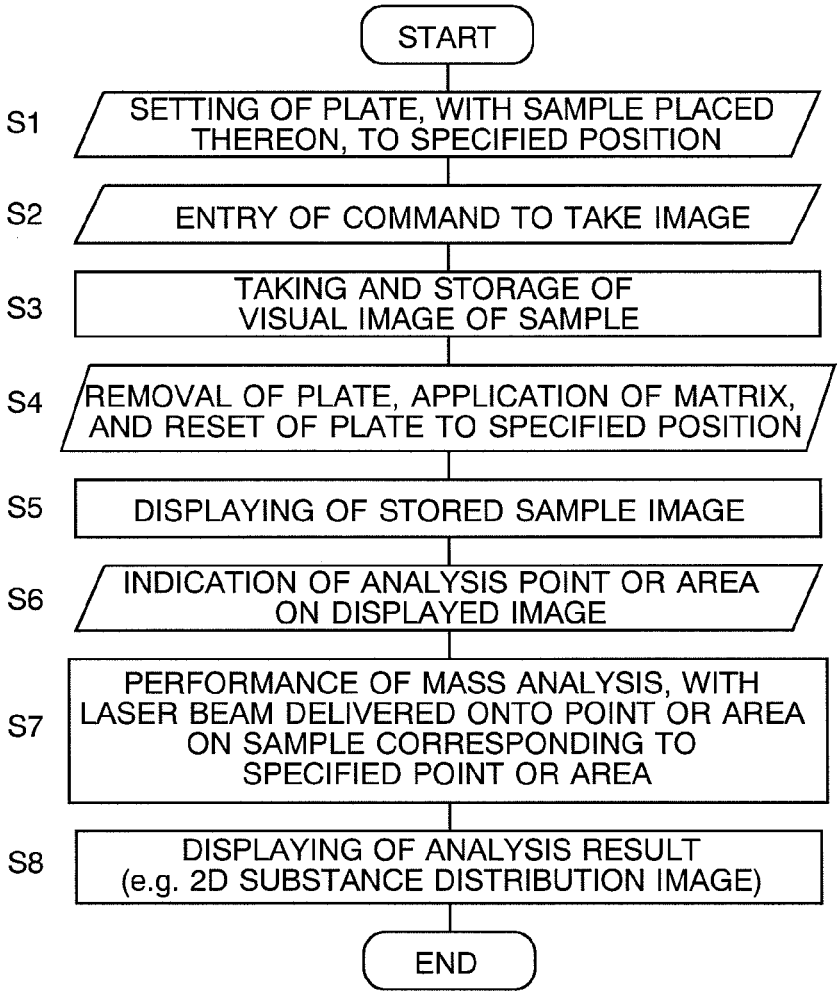
FIG. 2 is a flowchart showing the procedure of an analysis by the MALDI imaging mass spectrometer according to the first embodiment and the process operations associated with the procedure.
Figure 3:
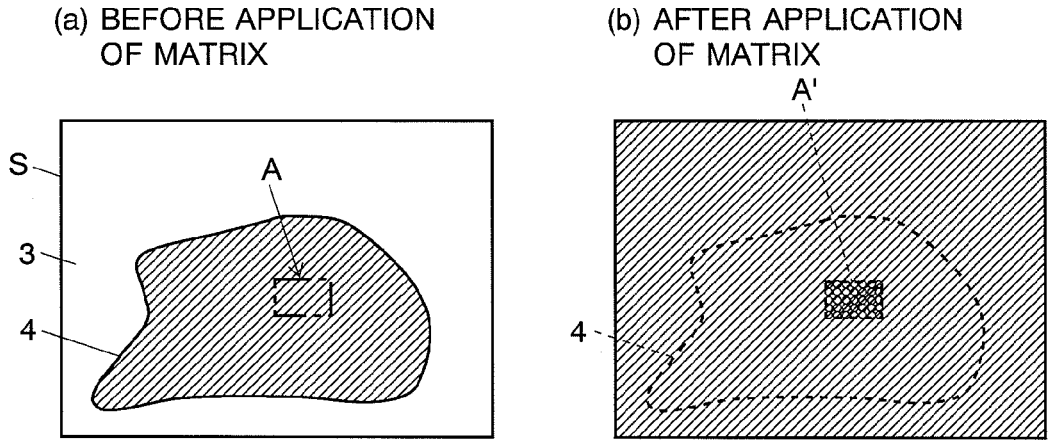
FIG. 3 is a diagram illustrating an area-specifying operation for an analysis of a two-dimensional area on a sample by the MALDI imaging mass spectrometer according to the first embodiment.

In FIG. 5, the operations and processes of Steps S11 through S16 are basically identical to Steps S1 through S6 in FIG. 2; therefore, explanations of those steps will be omitted. In the present case, after the sample plate 3 carrying the sample 4 with a matrix applied thereto is set onto the stage 2, a visual image of the sample with the matrix applied thereto is taken with the CCD camera 14. This visual image S', an example of which is shown in FIG. 6(*b*), is displayed on the screen of the display unit 24 together with a visual image S of the sample taken before the application of the matrix, like the one shown in FIG. 6(*b*), which is stored in the image data memory 23. If the sample 4 has a characteristic portion that is unmistakably distinct due to its shape, color distribution, color density or the like, it may be possible to recognize that portion even on the visual image of the sample taken after the application of the matrix. Accordingly, the operator compares the two images S and S' and indicates any portions that seem to correspond to each other on those images, by a click or similar operation with the operation unit 25 (Step S17).

For example, it is assumed at this point that the points P1 and P1' as well as P2 and P2' in FIGS. 6(*a*) and 6(*b*) have been indicated as identical portions. The displacement recognizer 34 receives these indications through the operation unit 25, and the displacement calculator 35 computes the direction (or angle) and magnitude of the displacement from the coordinate values of these points that have been regarded as identical (Step S18). For example, on the assumption that the point P1 has moved to P1' and the point P2 to P2', it is possible to draw two vectors. These vectors form a basis for calculating the direction and magnitude of the movement of the image from S to S', provided that the movement is a simple movement that does not include scaling (but may include rotation).

In the analysis point/area specifier 31, which has the same functions as those of the analysis point/area specifier 21 in the first embodiment, the coordinate values of the analysis point or area are specified on the visual image S of the sample taken before the application of the matrix. The displacement corrector 32 corrects the coordinate values of the analysis point or area, based on the information relating to the direction and magnitude of the displacement calculated by the displacement calculator 35. The analysis point/area determiner 33 receives the coordinate values of the analysis point or area in which the displacement has been corrected, and fixes those values as the targeted analysis area on the sample 4 with the matrix applied thereto (Step S19). As a result, for an area-indicating frame A specified on the visual image S of the sample as shown in FIG. 7(*a*), a corresponding analysis area A', which is displaced according to the displacement of the sample 4, is created on the sample 4 with the matrix applied thereto, as shown in FIG. 7(*b*), and the mass analysis is performed for each micro area within this analysis area A' (Step S20).

In the preceding description, two points were specified as the identical portions in Step S17. It is also possible to specify only one point. In this case, although a displacement in the form of a parallel translation can be corrected, a displacement accompanied by a rotation cannot be adequately corrected. Specifying three or more identical portions can improve the accuracy of calculation of the direction and magnitude of the displacement.

Third Embodiment

Figure 8:
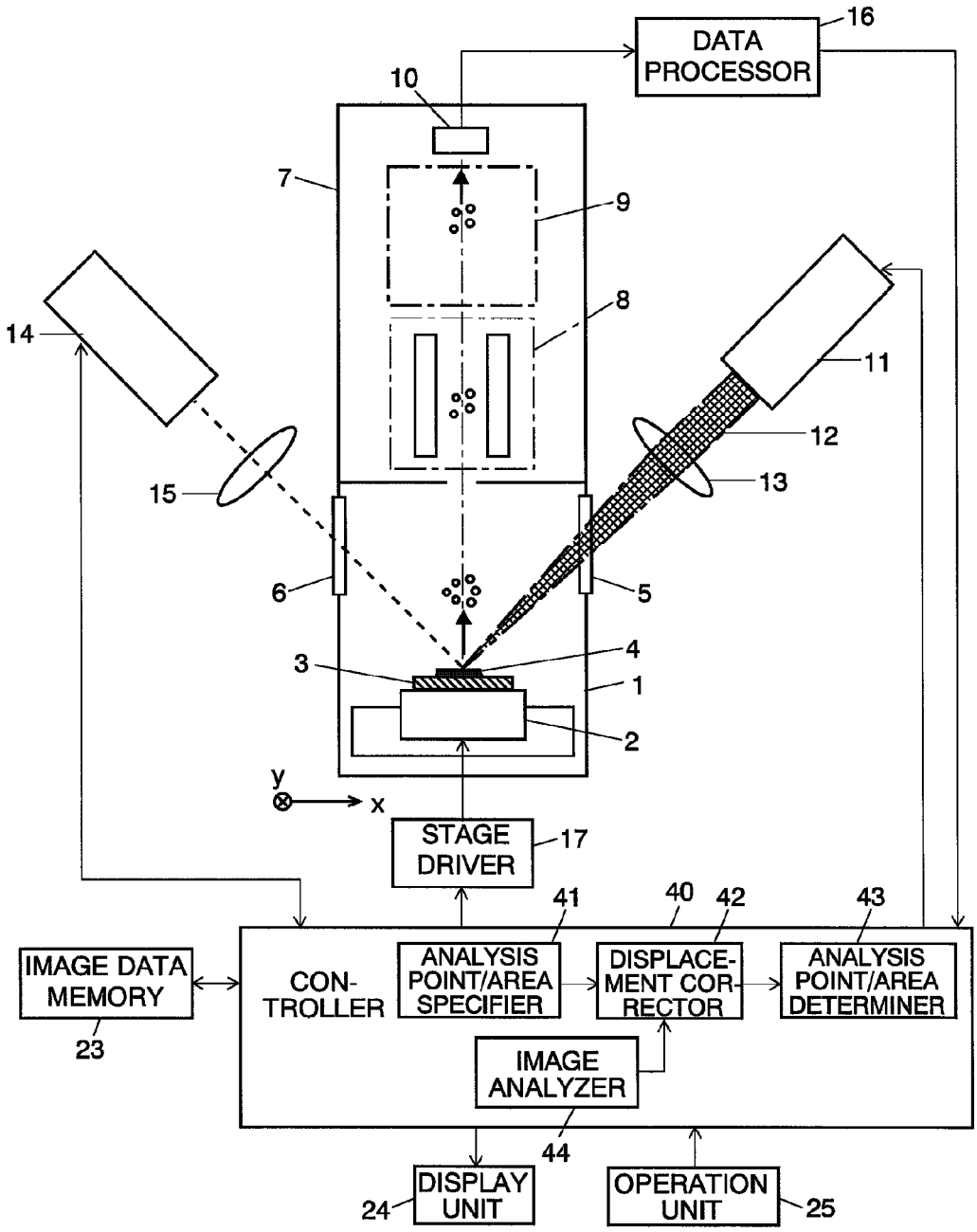
FIG. 8 is an overall configuration diagram of a MALDI imaging mass spectrometer according to the third embodiment of the present invention.

A MALDI imaging mass spectrometer, which is another embodiment (the third embodiment) of the mass spectrometer according to the present invention, is hereinafter described with reference to FIG. 8. FIG. 8 is an overall configuration diagram of the MALDI imaging mass spectrometer according of the third embodiment. The same components as those already described in the first embodiment shown in FIG. 1 or the second embodiment shown in FIG. 4 will be denoted by the same numerals, and their explanations will be omitted.

In the second embodiment, it was necessary for the operator to check the visual images of the sample taken before and after the application of the matrix and manually specify one or more apparently identical portions through the operation unit 25. By contrast, the apparatus in the third embodiment automatically determines the identical portions by an image analysis. That is, the controller 30 in the second embodiment has been replaced by a controller 40, which includes an image analyzer 44 in addition to an analysis point/area specifier 41, displacement corrector 42 and analysis point/area determiner 43.

After the sample plate 3 with the matrix applied thereto is set onto the stage 2 and a visual image of the sample is taken with the CCD camera 14, the image analyzer 44 loads both the visual image S' of the sample taken after the application of the matrix and the visual image S of the sample taken before the application of the matrix and stored in the image data memory 23, and compares the two images to calculate the direction and magnitude of the displacement. Such a processing function can be realized by high-performance image analysis software programs which have been commercially available in recent years. Thus, the present apparatus is capable of correcting the displacement of the sample with the matrix applied thereto, and performing the mass analysis for a desired analysis point or area without relying upon the visual check by the operator.

Fourth Embodiment

Figure 9:
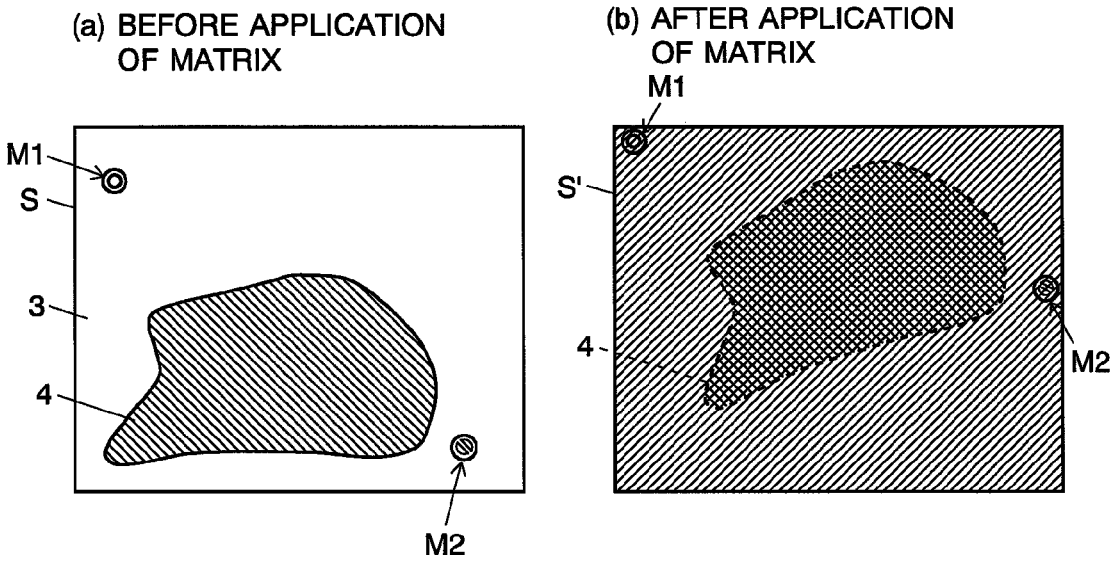
FIG. 9 is a diagram illustrating an area-specifying operation for an analysis of a two-dimensional area on a sample by the MALDI imaging mass spectrometer according to the fourth embodiment.

A MALDI imaging mass spectrometer, which is another embodiment (the fourth embodiment) of the mass spectrometer according to the present invention, is hereinafter described with reference to FIG. 9. The configuration of the imaging mass spectrometer of the fourth embodiment is basically the same as that of the second or third embodiment.

Generally, there are various kinds of samples and it is therefore possible that the sample concerned has no characteristic portion with a distinct shape, pattern, color density or the like. Even if a characteristic portion is present, the portion may be difficult to locate because of a matrix being applied in an unfavorable manner. Given these problems, the apparatus in the fourth embodiment uses a sample plate 3 on which markings (or patterns) are provided so that the displacement can be more assuredly detected on the visual image. Specifically, as shown in FIG. 9(*a*), the sample plate 3 has markings M1 and M2 respectively located at two separate positions. As shown in FIG. 9(*b*), these markings M1 and M2 are distinct enough to be observed even if the matrix is densely sprayed. With reference to these markings M1 and M2, the operator can specify identical portions on the two visual images S and S' of the sample respectively taken before and after the application of the matrix.

Use of the markings M1 and M2 as a reference also facilitates the calculation of the direction and magnitude of a displacement in the case of automatically detecting the displacement by an image analysis as in the third embodiment. In this case, it is possible to preliminarily supply the image analyzer 44 with information about the shape or other properties of the markings M1 and M2 so that it can easily recognize the markings M1 and M2 and quickly calculate the direction and magnitude of displacement.

If the markings M1 and M2 have been obscured by the sprayed matrix, it is possible to make the markings M1 and M2 easy to recognize by wiping off the matrix from only those portions without disturbing the sample on the sample plate 3.

It is possible to provide three or more markings on the sample plate 3. Furthermore, it is not necessary to indicate the positions of plural markings within the same scope of observation, as in the previous example of FIG. 9 where the positions of the markings M1 and M2 were indicated as identical portions when the markings M1 and M2 were located within the same scope of observation (i.e. a single visual image of the sample).

Figure 10:
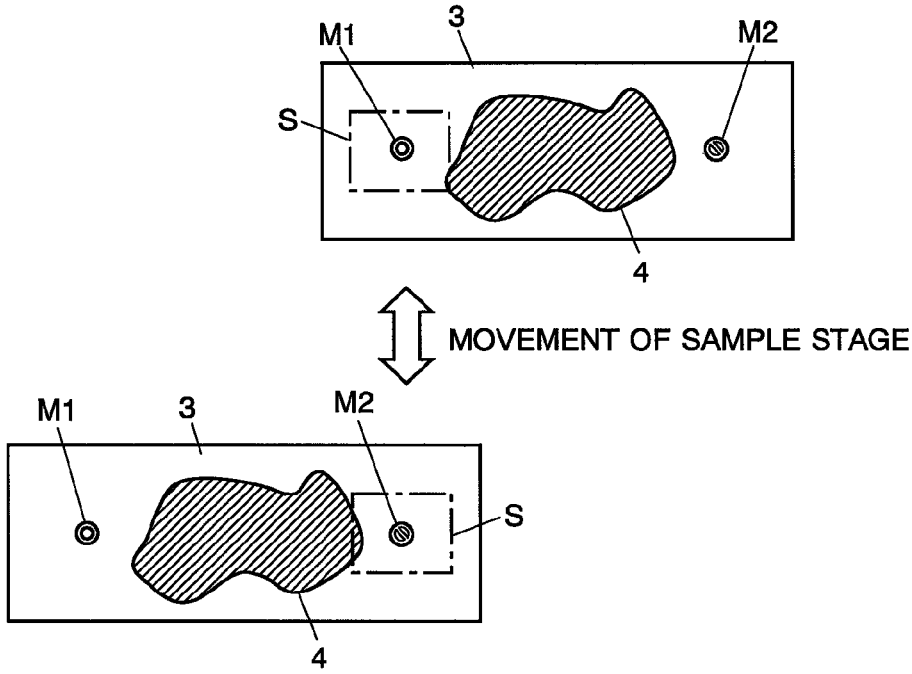
FIG. 10 is a diagram illustrating an area-specifying operation for an analysis of a two-dimensional area on a sample by the MALDI imaging mass spectrometer according to a modification of the fourth embodiment.

FIG. 10 shows an example in which the sample plate 3 has two markings M1 and M2 located at widely separated positions. In this case, any attempt to bring both of the markings M1 and M2 into the same scope of observation requires reducing the magnification of the observed image, which impedes the accurate recognition of the positions of the markings M1 and M2. This situation can be avoided as follows: First, the position of the stage 2 is adjusted to bring the marking M1 into the scope of the visual image S of the sample, and the position of the marking M1 is indicated within the image S. Next, the position of the stage 2 is adjusted to bring the other marking M2 into the scope of the visual image S of the sample, and the position of the marking M2 is indicated within the image S. Even if the stage 2 is moved by the drive mechanism in this manner, if its movement distance can be correctly determined, it is possible to convert the movement distance into coordinate values, so that the displacement between the positions of the sample plate 3 before and after the application of the matrix can be calculated as coordinate values.

In the case of indicating the positions of the plural markings M1 and M2 by moving the stage 2, the indication of the positions of the markings M1 and M2 on the sample plate 3 before the application of the matrix must be performed before the plate 3 is temporarily removed from the stage 2; for example, in the flowchart of FIG. 5, the indication of the positions of the markings M1 and M2 on the sample plate 3 before the application of the matrix must be performed in or after Step S11 and before Step S14. Setting a large distance between the plural markings, as in the present case, is particularly effective in improving the correction accuracy of a rotational displacement.

Fifth Embodiment

A MALDI imaging mass spectrometer, which is another embodiment (the fifth embodiment) of the mass spectrometer according to the present invention, is hereinafter described with reference to FIG. 11. The fifth embodiment is an expansion of the fourth embodiment and has the markings for displacement detection provided on a plate holder for securely holding the sample plate 3 instead of having the markings on the sample plate 3 itself.

Figure 11:
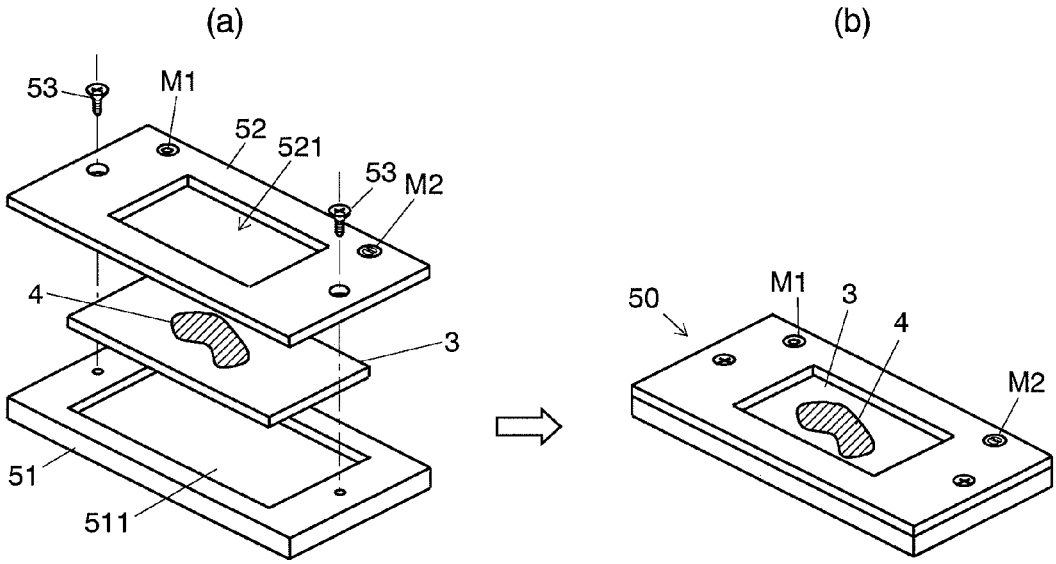
FIGS. 11(*a*) and 11(*b*) are an assembly diagram and completion diagram showing the structure of a plate holder used in a MALDI imaging mass spectrometer according to the fifth embodiment of the present invention.

FIG. 11(*a*) is a perspective view showing the process of assembling the sample plate 3 and a plate holder 50, and FIG. 11(*b*) is a perspective view showing the assembled state. The plate holder 50 consists of a body 51 in which a hollow 511 slightly larger than the outline size of the sample plate 3 is formed, and a cover 52 to be overlaid on the body 51. The cover has an open window 521 smaller than the outline size of the sample plate 3. Two markings M1 and M2 are provided separately from each other on the cover 52. After the sample plate 3 with a sample 4 placed thereon is fit into the hollow 511 of the body 51, the cover 52 is overlaid on the plate, and screws 53 are tightened into the tapped holes at both ends of the cover 52 to anchor it to the body 51. The sample plate 3 has its peripheral portion pressed by the cover 52 and thereby anchored to the plate holder 50.

The sample plate 3 is maintained in the state of being securely held by the plate holder 50 as described previously when it is set onto the stage 2 of the apparatus. When a matrix is to be sprayed, the plate holder 50 with the plate is removed as a unit from the stage 2. The process of discerning and correcting a displacement by using the markings M1 and M2 on the cover 52 of the plate holder 50 placed on the stage 2 is the same as in the second through fourth embodiments.

Normally, the sample 4 is transported or stored in the state of being placed on the sample plate 3. Accordingly, it is usually necessary to prepare as many sample plates 3 as the samples 4. Compared to a sample plate 3 with no markings, a sample plate 3 on which markings are directly provided as in the fourth embodiment is more expensive; preparing a large number of such sample plates imposes a significant cost on the user. By contrast, the plate holder 50 can be commonly used for a large number of sample plates 3 and hence advantageous in reducing the total cost. Another advantage exists in that the sample plate 3 held by the plate holder 50 is easy to handle when removing it from or resetting it onto the stage 2.

Providing the markings M1 and M2 on the plate holder 50 in this manner is particularly advantageous in the case of automatically searching for the markings as in the third embodiment. For example, even if a number of sample plates 3 differing in size are used for a variety of samples, the markings M1 and M2 will be located almost at the same positions if the analysis is performed using the same plate holder 50 or a plurality of plate holders 50 with a minor dimension tolerance. This facilitates the operation of automatically moving the stage 2 to locate the markings M1 and M2. Naturally, the same effect can also be obtained in the case of the fourth embodiment by using sample plates 3 with a minor dimension tolerance. However, producing a large number of sample plates 3 with a minor dimension tolerance is expensive. By contrast, producing a small number of plate holders 50 with a minor dimension tolerance is less expensive.

Figure 12:
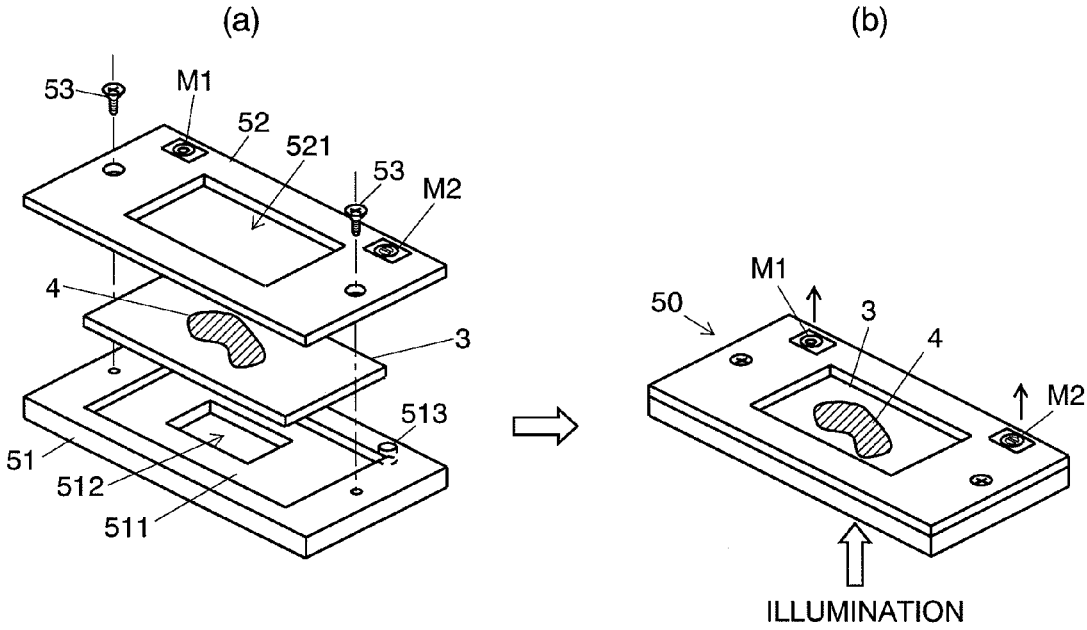
FIGS. 12(*a*) and 12(*b*) are an assembly diagram and completion diagram showing the structure of a plate holder used in a MALDI imaging mass spectrometer according to a modification of the fifth embodiment.
Figure 13:
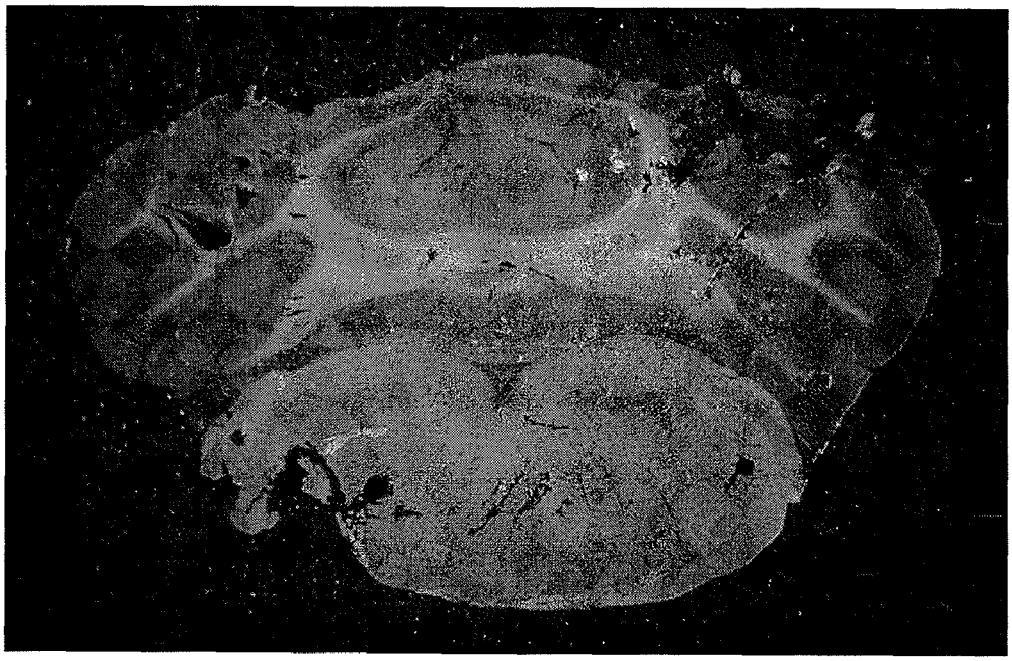
FIGS. 13(*a*) and 13(*b*) are photographic images of the sample observed before and after the matrix solution is sprayed.
Figure 13:
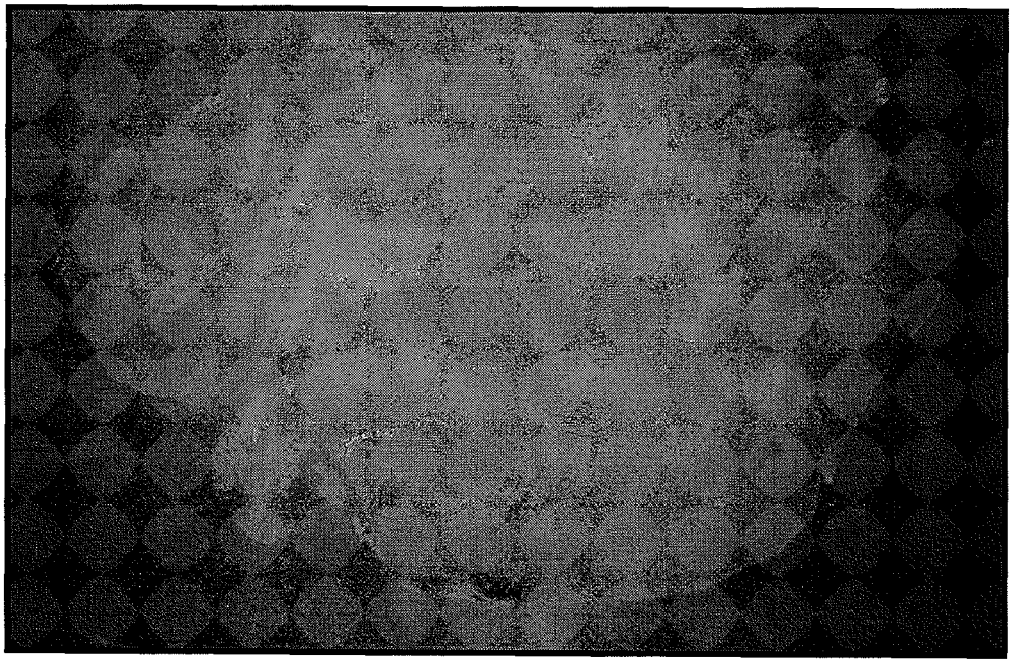

FIG. 12(*a*) is a perspective view showing the process of assembling the sample plate 3 and a plate holder 50 according to a modification of the fifth embodiment, and FIG. 12(*b*) is a perspective view showing the assembled state. The plate holder 50 shown in FIG. 11 is basically premised on the use of a vertical illumination optical system for casting light from above when the sample is observed. However, in the case of analyzing a biological sample, it is often desirable to perform a transmission observation in which the sample is illuminated from below and a sample image is taken from above. Accordingly, the plate holder 50 shown in FIG. 12 has an opening 512 at the bottom of the hollow 511 of the body 51. This opening 512 forms a passage for light to illuminate the lower surface of the sample plate 3 from below. In this case, the sample plate 3 should consist of a glass plate, transparent resin sheet or similar transparent element so that the light impinging on the lower surface of the sample plate 3 can penetrate upwards. To prevent a decrease in the ionization efficiency due to electrification, it is preferable, for example, to make the surface of the glass plate or transparent resin sheet electrically conductive by coating it with an appropriate material, such as ITO (indium tin oxide).

The cover 52 is made of, for example, a transparent resin. The markings M1 and M2 need to be easily recognized when illuminated by transmission light from below. Such a marking can be created by, for example, carving a pattern on the base material. The body 51 has a light-passing window 513 at each of the positions that will be located directly below the markings M1 and M2 when the cover 52 is attached. As a result of these designs, when light is cast from a transmission optical system from below as shown FIG. 12(*b*), the sample 4 can be observed through the transmission illumination, and the markings M1 and M2 can be easily recognized.

It should be noted that the previous embodiments are mere examples of the present invention, and any change, modification or addition appropriately made within the spirit of the present invention will naturally fall within the scope of the claims of this patent application.

For example, instead of detecting the displacement of the sample plate 3 or sample 4 by using a visual image taken with the CCD camera 14 as in the second through fifth embodiments, the imaging mass spectrometer may alternatively include a position sensor, such as a laser type, capacitance type, optical fiber type or other non-contact types, to detect the position of the sample plate 3 or plate holder 50 on the stage 2 by using the position sensor and determine the displacement.

The invention claimed is:

1. A mass spectrometer having an apparatus body in which a sample plate, on which a sample is to be placed, can be set in a removable manner, and an ion source for ionizing the sample by matrix-assisted laser desorption ionization, comprising:

a) an image acquiring section for taking a two-dimensional image of the sample on the sample plate when the sample plate carrying the sample with no matrix applied thereto is set in the apparatus body, and for storing the two-dimensional image in a storage;

b) a specifying section for reading out the two-dimensional image from the storage, and for specifying a desired point on the two-dimensional image; and c) an analysis controlling section for delivering the laser beam at the point specified through the specifying section, and for performing a mass analysis on the sample plate carrying the sample with the matrix applied thereto set in the apparatus body.

2. A mass spectrometer having an apparatus body in which a sample plate, on which a sample is to be placed, can be set in a removable manner, and an ion source for ionizing the sample by matrix-assisted laser desorption ionization, comprising:

a) an image acquiring section for taking a two-dimensional image of the sample on the sample plate when the sample plate carrying the sample with no matrix applied thereto is set in the apparatus body, and for storing the two-dimensional image in a storage;

b) a specifying section for reading out the two-dimensional image from the storage, and for specifying a desired one-dimensional line or two-dimensional area on the two-dimensional image;

c) a laser beam delivering section for delivering a laser beam onto an irradiating position to scan the one-dimensional line or two-dimensional area; and d) an analysis controlling section for moving the irradiating position in the one-dimensional line or two-dimensional area specified through the specifying section, and for performing a mass analysis on the sample plate carrying the sample with the matrix applied thereto set in the apparatus body.

3. The mass spectrometer according to claim 1, which is characterized by further comprising:

a displacement discerning section for discerning a direction and magnitude of a displacement between positions of either the sample plate or the sample on the sample plate before and after removal and replacement of the sample plate from and into the apparatus body; and an irradiating position adjustment section for changing a relative position of the laser beam and the sample so as to correct the irradiating position of the laser beam according to the direction and magnitude of the displacement discerned by the displacement discerning section.

4. The mass spectrometer according to claim 3, which is characterized in that the displacement discerning section displays a two-dimensional image of the sample on the sample plate taken when the sample plate carrying the sample with the matrix applied thereto is set in the apparatus body and a two-dimensional image of the sample taken before an application of the matrix and held by the image acquiring section, in such a manner as to allow comparison between the two images, and discerns the direction and magnitude of the displacement on a basis of an operator indication relating to one or more identical portions on both of the two-dimensional images.

5. The mass spectrometer according to claim 3, which is characterized by further comprising:

a comparative image acquiring section for taking a two-dimensional image of the sample on the sample plate when the sample plate carrying the sample with the matrix applied thereto is set in the apparatus; and a displacement detecting section for performing an image analysis on both of the two-dimensional image taken by the comparative image acquiring section and the two-dimensional image of the sample taken before an application of the matrix and held by the image acquiring section, to determine the direction and magnitude of the displacement between these two images.

6. The mass spectrometer according to claim 3, which is characterized in that:

a marker for position identification is provided on the sample plate; and the displacement discerning section discerns the direction and magnitude of the displacement by using the marker.

7. The mass spectrometer according to claim 3, which is characterized in that:

a marker for position identification is provided on a holder that can hold the sample plate and be set into the apparatus body; and the displacement discerning section discerns the direction and magnitude of the displacement by using the marker.

8. The mass spectrometer according to claim 4, which is characterized in that:

a marker for position identification is provided on the sample plate; and the displacement discerning section discerns the direction and magnitude of the displacement by using the marker.

9. The mass spectrometer according to claim 5, which is characterized in that:

a marker for position identification is provided on the sample plate; and the displacement discerning section discerns the direction and magnitude of the displacement by using the marker.

10. The mass spectrometer according to claim 4, which is characterized in that:

a marker for position identification is provided on a holder that can hold the sample plate and be set into the apparatus body; and the displacement discerning section discerns the direction and magnitude of the displacement by using the marker.

11. The mass spectrometer according to claim 5, which is characterized in that:

a marker for position identification is provided on a holder that can hold the sample plate and be set into the apparatus body; and the displacement discerning section discerns the direction and magnitude of the displacement by using the marker.

12. The mass spectrometer according to claim 2, which is characterized by further comprising:

a displacement discerning section for discerning a direction and magnitude of a displacement between positions of either the sample plate or the sample on the sample plate before and after removal and replacement of the sample plate from and into the apparatus body; and an irradiating position adjustment section for changing a relative position of the laser beam and the sample so as to correct the irradiating position of the laser beam according to the direction and magnitude of the displacement discerned by the displacement discerning section.

13. The mass spectrometer according to claim 12, which is characterized in that the displacement discerning section displays a two-dimensional image of the sample on the sample plate taken when the sample plate carrying the sample with the matrix applied thereto is set in the apparatus body and a two-dimensional image of the sample taken before an application of the matrix and held by the image acquiring section, in such a manner as to allow comparison between the two images, and discerns the direction and magnitude of the displacement on a basis of an operator indication relating to one or more identical portions on both of the two-dimensional images.

14. The mass spectrometer according to claim 12, which is characterized by further comprising:

a comparative image acquiring section for taking a two-dimensional image of the sample on the sample plate when the sample plate carrying the sample with the matrix applied thereto is set in the apparatus; and a displacement detecting section for performing an image analysis on both of the two-dimensional image taken by the comparative image acquiring section and the two-dimensional image of the sample taken before an application of the matrix and held by the image acquiring section, to determine the direction and magnitude of the displacement between these two images.

15. The mass spectrometer according to claim 12, which is characterized in that:

a marker for position identification is provided on the sample plate; and the displacement discerning section discerns the direction and magnitude of the displacement by using the marker.

16. The mass spectrometer according to claim 13, which is characterized in that:

a marker for position identification is provided on the sample plate; and the displacement discerning section discerns the direction and magnitude of the displacement by using the marker.

17. The mass spectrometer according to claim 14, which is characterized in that:

a marker for position identification is provided on the sample plate; and the displacement discerning section discerns the direction and magnitude of the displacement by using the marker.

18. The mass spectrometer according to claim 12, which is characterized in that:

a marker for position identification is provided on a holder that can hold the sample plate and be set into the apparatus body; and the displacement discerning section discerns the direction and magnitude of the displacement by using the marker.

19. The mass spectrometer according to claim 13, which is characterized in that:

a marker for position identification is provided on a holder that can hold the sample plate and be set into the apparatus body; and the displacement discerning section discerns the direction and magnitude of the displacement by using the marker.

20. The mass spectrometer according to claim 14, which is characterized in that:

a marker for position identification is provided on a holder that can hold the sample plate and be set into the apparatus body; and the displacement discerning section discerns the direction and magnitude of the displacement by using the marker.

21. A method of operating mass spectrometer having an apparatus body in which a sample plate, on which a sample is to be placed, can be set in a removable manner, and an ion source for ionizing the sample by matrix-assisted laser desorption, comprising steps of:

a) an image acquiring step of taking a two-dimensional image of the sample on the sample plate when the sample plate carrying the sample with no matrix applied thereto is set in the apparatus body, and of storing the two-dimensional image in a storage;

b) a specifying step of reading out the two-dimensional image from the storage, and of specifying a desired point on the two-dimensional image; and c) an analysis controlling step of delivering the laser beam at the specified through the specifying step, and of performing a mass analysis on the sample plate carrying the sample with the matrix applied thereto set in the apparatus body.

22. A method of operating mass spectrometer having an apparatus body in which a sample plate, on which a sample is to be placed, can be set in a removable manner, and an ion source for ionizing the sample by matrix-assisted laser desorption, comprising steps of:

a) an image acquiring step of taking a two-dimensional image of the sample on the sample plate when the sample plate carrying the sample with no matrix applied thereto is set in the apparatus body, and of storing the two-dimensional image in a storage;

b) a specifying step of reading out the two-dimensional image from the storage, and of specifying a desired one-dimensional line or two-dimensional area on the two-dimensional image;

c) a laser beam delivering step of delivering a laser beam onto an irradiating position to scan the one-dimensional line or two-dimensional area; and d) an analysis controlling step of moving the irradiating position in the one-dimensional line or two-dimensional area specified through the specifying step, and of performing a mass analysis on the sample plate carrying the sample with the matrix applied thereto set in the apparatus body.

23. The method according to claim 21, further comprising:

a displacement discerning step of discerning a direction and magnitude of a displacement between positions of either the sample plate or the sample on the sample plate before and after removal and replacement of the sample plate from and into the apparatus body; and an irradiating position adjustment step of changing a relative position of the laser beam and the sample so as to correct the irradiating position of the laser beam according to the direction and magnitude of the displacement discerned by the displacement discerning section.

24. The method according to claim 23, wherein the displacement discerning step comprises displaying a two-dimensional image of the sample on the sample plate taken when the sample plate carrying the sample with the matrix applied thereto is set in the apparatus body and a two-dimensional image of the sample taken before an application of the matrix and held by the image acquiring section, in such a manner as to allow comparison between the two images, and discerning the direction and magnitude of the displacement on a basis of an operator indication relating to one or more identical portions on both of the two-dimensional images.

25. The method according to claim 23, further comprising:

a comparative image acquiring step of taking a two-dimensional image of the sample on the sample plate when the sample plate carrying the sample with the matrix applied thereto is set in the apparatus; and a displacement detecting step of performing an image analysis on both of the two-dimensional image taken by the comparative image acquiring section and the two-dimensional image of the sample taken before an application of the matrix and held by the image acquiring section, to determine the direction and magnitude of the displacement between these two images.

26. The method according to claim 23, wherein the displacement discerning step comprises discerning the direction and magnitude of the displacement by using a marker provided on the sample plate.

27. The method according to claim 23, wherein the displacement discerning step comprises discerning the direction and magnitude of the displacement by using a marker provided on a holder that can hold the sample plate and be set into the apparatus body.

28. The method according to claim 22, further comprising:

a displacement discerning step of discerning a direction and magnitude of a displacement between positions of either the sample plate or the sample on the sample plate before and after removal and replacement of the sample plate from and into the apparatus body; and an irradiating position adjustment step of changing a relative position of the laser beam and the sample so as to correct the irradiating position of the laser beam according to the direction and magnitude of the displacement discerned by the displacement discerning section.

29. The method according to claim 28, wherein the displacement discerning step comprises displaying a two-dimensional image of the sample on the sample plate taken when the sample plate carrying the sample with the matrix applied thereto is set in the apparatus body and a two-dimensional image of the sample taken before an application of the matrix and held by the image acquiring section, in such a manner as to allow comparison between the two images, and discerning the direction and magnitude of the displacement on a basis of an operator indication relating to one or more identical portions on both of the two-dimensional images.

30. The method according to claim 28, further comprising:

a comparative image acquiring step of taking a two-dimensional image of the sample on the sample plate when the sample plate carrying the sample with the matrix applied thereto is set in the apparatus; and a displacement detecting step of performing an image analysis on both of the two-dimensional image taken by the comparative image acquiring section and the two-dimensional image of the sample taken before an application of the matrix and held by the image acquiring section, to determine the direction and magnitude of the displacement between these two images.

31. The method according to claim 28, wherein the displacement discerning step comprises discerning the direction and magnitude of the displacement by using a marker provided on the sample plate.

32. The method according to claim 28, wherein the displacement discerning step comprises discerning the direction and magnitude of the displacement by using a marker provided on a holder that can hold the sample plate and be set into the apparatus body.

* * * * *